US007197966B1

(12) United States Patent
Hsieh

(10) Patent No.: US 7,197,966 B1
(45) Date of Patent: Apr. 3, 2007

(54) DEVICE FOR PIVOTING AND POSITIONING HEAD OF HAND TOOL

(76) Inventor: Chih-Ching Hsieh, 5F-2, No. 181, Sec. 2, Mei Tsun Rd., Taichung City (TW)

( * ) Notice: Subject to any disclaimer, the term of this patent is extended or adjusted under 35 U.S.C. 154(b) by 0 days.

(21) Appl. No.: 11/441,038

(22) Filed: May 26, 2006

(51) Int. Cl.
*B25B 23/16* (2006.01)
*B25G 1/00* (2006.01)

(52) U.S. Cl. ..... 81/177.9; 81/177.7; 81/177.8

(58) Field of Classification Search ..... 81/177.9, 81/177.7, 177.8; 403/93
See application file for complete search history.

(56) References Cited

U.S. PATENT DOCUMENTS 4,711,145 A * 12/1987 Inoue ..... 81/177.1
4,901,608 A * 2/1990 Shieh ..... 81/177.8
5,199,335 A * 4/1993 Arnold et al. ..... 81/177.8
6,000,302 A * 12/1999 Chiang ..... 81/177.8
6,216,567 B1 * 4/2001 Hu ..... 81/177.9
6,220,125 B1 * 4/2001 Lan ..... 81/177.9
6,857,341 B1 * 2/2005 Cheng ..... 81/177.8
7,000,507 B1 * 2/2006 Lin ..... 81/177.9
7,036,403 B2 * 5/2006 Lin ..... 81/177.8
7,051,625 B1 * 5/2006 Lee ..... 81/177.8

* cited by examiner

*Primary Examiner*—Joseph J. Hail, III
*Assistant Examiner*—Alvin J Grant

(57) ABSTRACT

A hand tool includes a head which has an insertion and first teeth are defined in an outer periphery of the insertion. The insertion is pivotably connected to a recess between two lugs on a handle and a first biasing device is connected to an inner end of the recess. A control member is located between the insertion and the inner end of the recess, and has second teeth which are engaged with the first teeth. A cam-like protrusion projects from an underside of the control member and includes a curved outer surface which is in contact with the first biasing device. The first and second teeth are disengaged from each other when pivoting the control member so that the head can be pivoted, the first and second teeth are engaged again when the control member are pivoted back such that the head is positioned at a desired position.

5 Claims, 4 Drawing Sheets

DEVICE FOR PIVOTING AND POSITIONING HEAD OF HAND TOOL

FIELD OF THE INVENTION

The present invention relates to a device for easily pivoting and positioning a head relative to a handle of a hand tool.

BACKGROUND OF THE INVENTION

A conventional hand toot generally includes a handle and a head which is used to access an object to be loosened or tightened. The head and the handle are located on the same plane so that the head cannot access the object if an obstacle is located beside the object. Therefore, a pivotable head is developed wherein the head can be pivoted relative to the handle so that the handle is located above the obstacle while the head accesses the object. However, there is a control button projecting from the handle and the user has to operate the control button to pivot the head, the control button itself might be another obstacle for using the hand tool. Besides the user has to operate the control button by one hand and pivot the head by the other hand.

The present invention intends to provide a device which does not have a control button projecting from the head and the head can be easily pivoted and positioned by simply pivoting a control member.

SUMMARY OF THE INVENTION

The present invention relates to hand tool that comprises a head having an insertion and a plurality of first teeth are defined in an outer periphery of the insertion. The insertion is pivotably received in a recess between two lugs on an end of a handle by a pin. A first biasing device is connected to an inner end of the recess end. A control member is located between the insertion and the inner end of the recess. The control member has a plurality of second teeth defined in a top thereof and the first teeth are engaged with the second teeth. A cam-like protrusion projects from an underside of the control member and includes a curved outer surface which is in contact with the first biasing device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
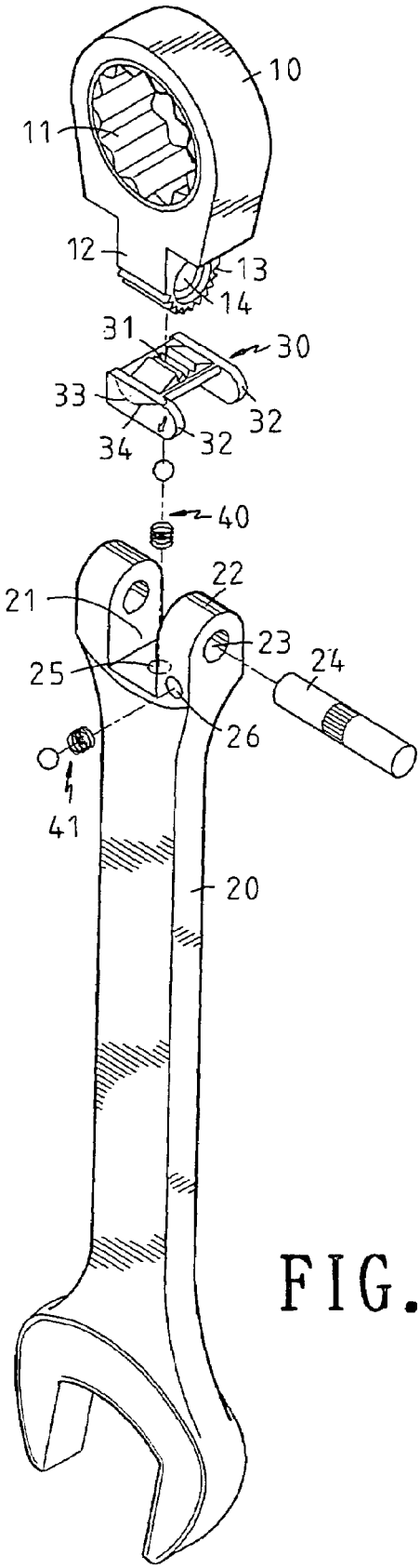
FIG. 1 is an exploded view to show the hand tool of the present invention.
Figure 2:
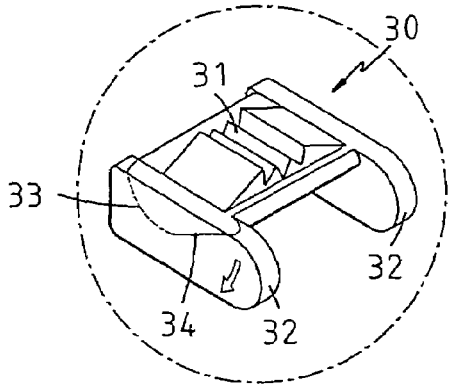
FIG. 2 is an enlarged view to show the control member of the hand tool of the present invention.
Figure 3:
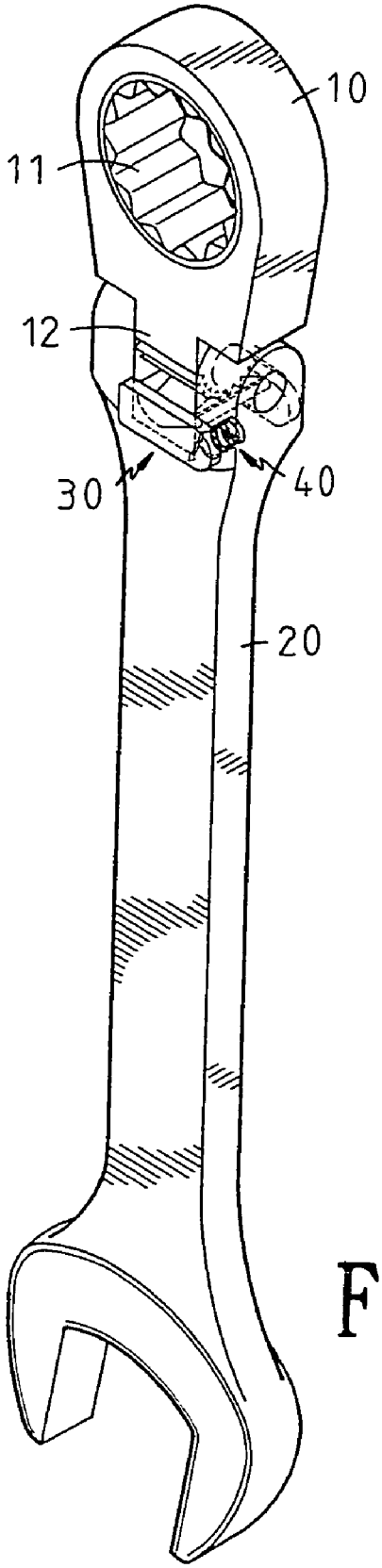
FIG. 3 is a perspective view to show the hand tool of the present invention.
Figure 4:
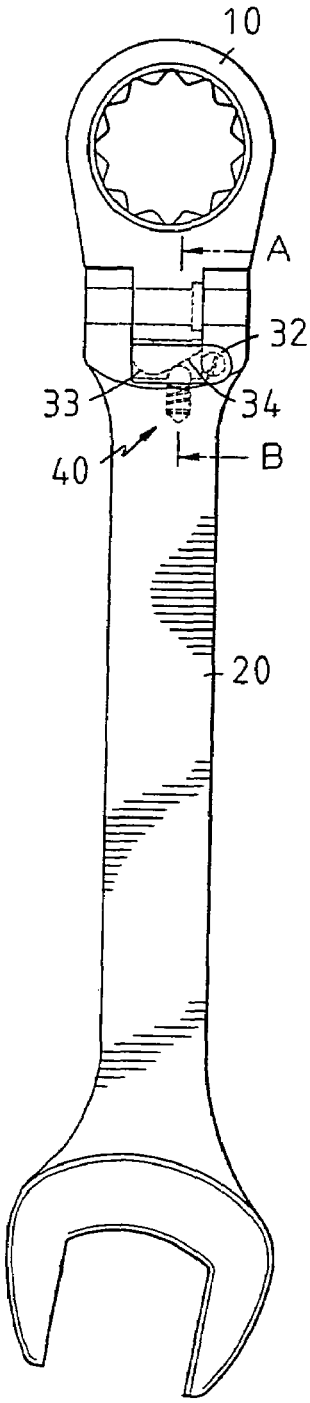
FIG. 4 is a cross sectional view to show that the head is not yet pivoted relative to the handle.
Figure 5:
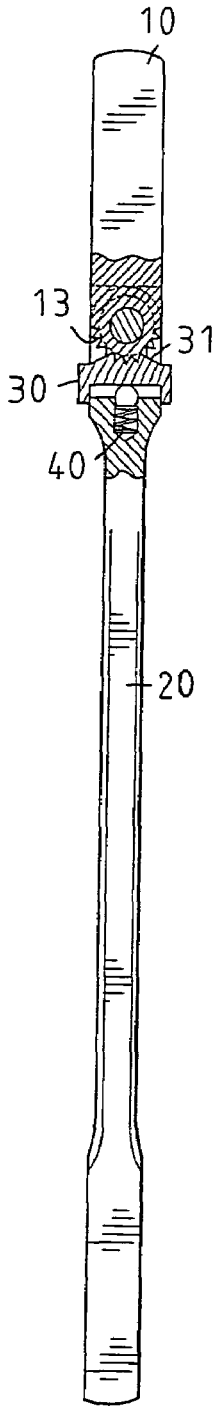
FIG. 5 is a side cross sectional view to show the hand tool as shown in FIG. 4.
Figure 6:
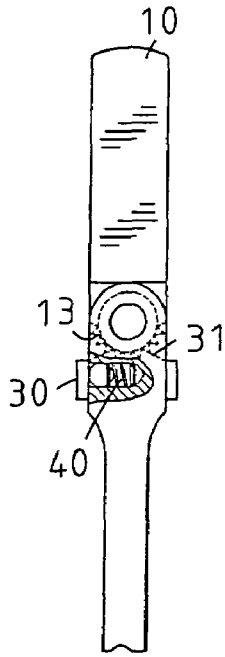
FIG. 6 shows that the second bead of the second biasing device is pressed into the second detent by the side plate of the control member.

Referring to FIGS. 1 to 6, the hand tool of the present invention comprises a head 10 which is a box end with a polygonal engaging hole 11 and an insertion 12 extends from the head 10. A plurality of first teeth 13 are defined in an outer periphery of the insertion 12 and a passage 14 is defined through the insertion 12.

A handle 20 has two lugs 22 extending from an end thereof and a recess 21 is defined between the two lugs 22. Each of the two lugs 22 has a through hole 23 and a pin 24 extends through the through holes 23 of the insertion 12 and the passage 14 in the insertion 12 to pivotably connect the insertion 12 to the two lugs 22. A first detent 25 is defined in the inner end of the recess 21 and a second dent 26 is defined in one of the two outsides of the lug 22. A first biasing device 40 includes a first spring and a first bead which is biased by the spring received in the first detent 25.

A control member 30 is located between the insertion 12 and the inner end of the recess 21. The control member 30 has a plurality of second teeth 31 defined in a top thereof and the first teeth 13 are engaged with the second teeth 31. A cam-like protrusion projects from an underside of the control member 30 and includes a first slope outer surface 33 and a second slope outer surface 34 which is in contact with the first biasing device 40. The control member 30 includes two side plates 32 which are located on two outsides of one of the two lugs 22.

A second biasing device 41 is connected to the lug 22 that the two side plates 32 are mounted. The second biasing device includes a second spring and a second bead which is biased by the second spring received in the second detent 26. The second bead projects from one of the two outsides of the lug 22 and a side of one of the two side plates 32 presses the second bead into the second detent 26 when the control member 30 is not yet pivoted as shown in FIGS. 3 to 6.

Figure 7:
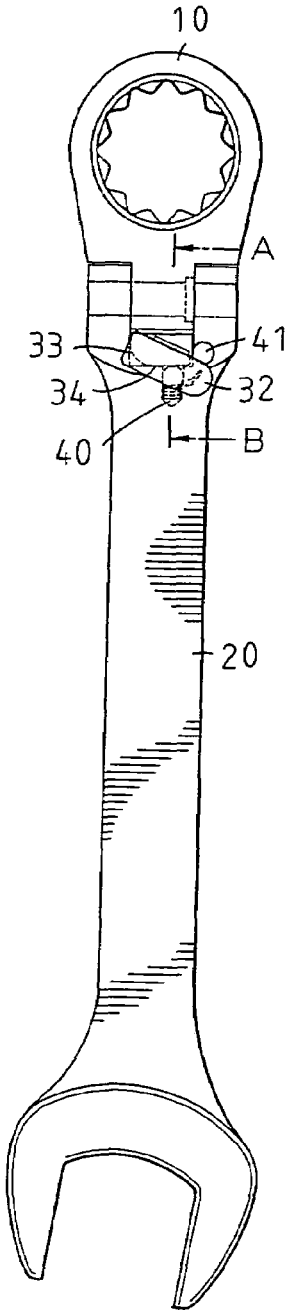
FIG. 7 is a cross sectional view to show that the head is pivoted relative to the handle.
Figure 8:
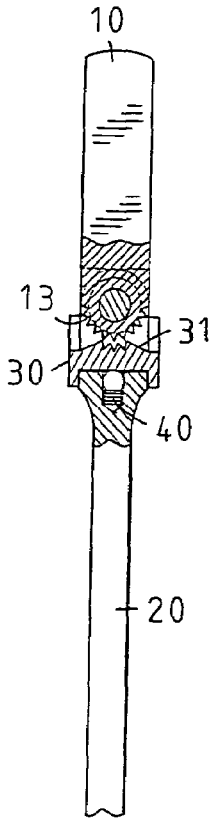
FIG. 8 shows that the control member is pivoted and the first and second teeth are disengaged from each other.
Figure 9:
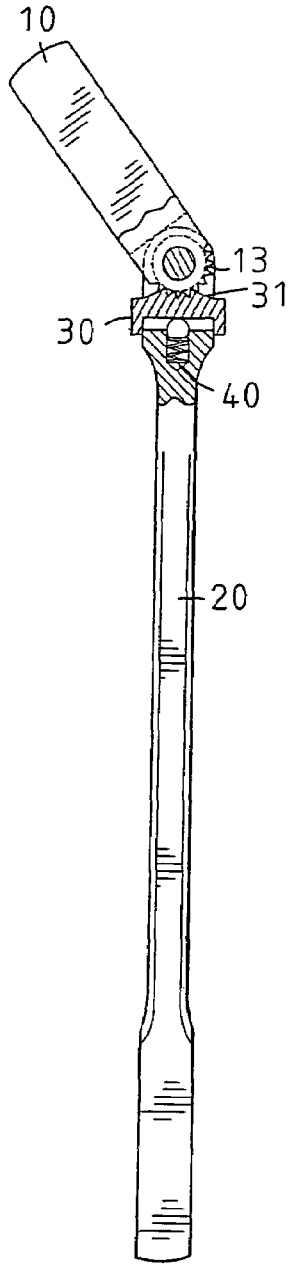
FIG. 9 shows that the control member is pivoted back again and the first and second teeth are engaged with each other.

As shown in FIGS. 7 to 9, when the user wants to pivot the head 10, he or she pivots one of the two side plates 32 of the control member 30, the side plate 32 on the same side the second biasing device 41 is located is moved over and stopped by the second biasing device when the control member 30 is pivoted. The pivotal movement of the control member 30 allows the first slope outer surface 33 of the cam-like protrusion 33 to contact against an inner side of one of the two lugs 22, and the second slope outer surface 34 is lowered so as to push the first bead of the biasing device 40 into the first detent 25 such that the first and second teeth 13, 31 are disengaged from each other. The head 10 is then easily pivoted to a desired angle. When the head 10 is pivoted to a desired position, the user pushes the side plate 32 back to its original position by overcoming the second spring of the second biasing device 41, so that the first and second teeth 13 and 31 are engaged with each other again, and the head 10 is positioned at that position.

The operation can be completed by one hand and there is no obvious part projecting from the head 10 or the handle 20.

While we have shown and described the embodiment in accordance with the present invention, it should be clear to those skilled in the art that further embodiments may be made without departing from the scope of the present invention.

What is claimed is:

1. A hand tool comprising:

a head having an insertion portion and a plurality of first teeth defined in an outer periphery of the insertion portion;

a handle having two lugs and a recess defined between the two lugs, a first biasing device connected to an inner end of the recess, the insertion portion of the head being pivotably received in the recess by a pin;

a control member located between the insertion portion and the inner end of the recess, the control member having a plurality of second teeth defined in a top thereof and the first teeth engaged with the second teeth, a cam-like protrusion projecting from an underside of the control member and including a first slope outer surface and a second slope outer surface which is in contact with the first biasing device, the control member including two side plates which are located on two outsides of one of the two lugs, and a second biasing device connected to the lug on which the two side plates are mounted, the second biasing device projecting from one of the two outsides of the lug and a side of one of the two side plates moved over and stopped by the second biasing device when the control member is pivoted.

2. The hand tool as claimed in claim 1, wherein a first detent is defined in the inner end of the recess and the first biasing device includes a first spring and a first bead which is biased by the spring received in the first detent, the first bead is pushed into the first detent by the cam-like protrusion when the control member is pivoted.

3. The hand tool as claimed in claim 1, wherein a second detent is defined in one of the two outsides of the lug and the second biasing device includes a second spring and a second bead which is biased by the second spring received in the second detent, the side of the side plate is moved over and stopped by the second bead when pivoting the control member.

4. The device as claimed in claim 1, wherein the insertion portion has a passage defined therethrough and each of the two lugs has a through hole, the pin extends through the through holes of the insertion portion and the passage in the insertion portion.

5. The device as claimed in claim 1, wherein the first slope outer surface of the cam-like protrusion is in contact with an inner side of one of the two lugs.

* * * * *